US006812475B1

(12) United States Patent
Huang

(10) Patent No.: US 6,812,475 B1
(45) Date of Patent: Nov. 2, 2004

(54) DEVICE FOR STORING RADIOACTIVE MATERIAL AND SHIPPING APPARATUS FOR THE SAME

(76) Inventor: Roger C. P. Huang, 24971 Palmilla Dr., Calabasas, CA (US) 91302

( * ) Notice: Subject to any disclaimer, the term of this patent is extended or adjusted under 35 U.S.C. 154(b) by 0 days.

(21) Appl. No.: 10/768,101

(22) Filed: Feb. 2, 2004

(51) Int. Cl.[7] ..... G21F 5/00; G21F 5/12
(52) U.S. Cl. ..... 250/507.1; 250/506.1
(58) Field of Search ..... 250/506.1, 507.1, 250/260, 518.1, 517.1

(56) References Cited

U.S. PATENT DOCUMENTS 3,754,140 A * 8/1973 Beierle ..... 250/507.1
4,535,250 A * 8/1985 Fields ..... 250/507.1
4,738,388 A * 4/1988 Bienek et al. ..... 228/135
4,786,805 A * 11/1988 Priest ..... 250/260
5,391,887 A * 2/1995 Murray, Jr. ..... 250/506.1
5,834,788 A * 11/1998 Fu et al. ..... 250/506.1
6,452,200 B1 * 9/2002 Kotler ..... 250/506.1
6,538,259 B2 * 3/2003 Matsunaga et al. ..... 250/506.1
6,718,000 B2 * 4/2004 Singh et al. ..... 376/272

* cited by examiner

*Primary Examiner*—Nikita Wells
*Assistant Examiner*—Johnnie L Smith, II

(57) ABSTRACT

A storing device includes a radioactive material container, a radioactive material container outer shield and a ring member. The container includes a lower cup portion, an upper cup portion which is securely engaged to the lower cup portion, and a chamber with a cushion member mounted in a top and a bottom end thereof, which is formed inside the container for storing radioactive material. The outer shield includes a base portion and a lid which is securely covered on the base portion, the base portion further including a room to accommodate the radioactive material container. The ring member is pivotedly mounted to a top end of radioactive material container, and is rested between the lid and the upper cup portion. When the lid is opened, the ring member will stand out of the base portion for a tool to conveniently move out the container from the outer shield.

18 Claims, 9 Drawing Sheets

DEVICE FOR STORING RADIOACTIVE MATERIAL AND SHIPPING APPARATUS FOR THE SAME

BACKGROUND OF THE INVENTION

The present invention relates to a safety storage/transport container, and more particular, to a device for storing radioactive material and a shipping apparatus for transporting the storage device.

Conventional delivery containers for storing and packaging radioactive material are normally made by lead. Usually, when the radioactive material carries higher contamination, the container with thicker wall is provided to secure the shielding.

However, the conventional containers are singly structured and do not provide effective shielding to protect the operating personnel and the surrounding environment. Therefore, it still needs improvement to obtain a reliable device for storing radioactive material and a safety shipping apparatus for transporting the storage device.

BRIEF SUMMARY OF THE INVENTION

The present invention provides a device for storing radioactive material, which is doubly structured with a radioactive material container and a radioactive material container outer shield to enhance the shielding effect. Moreover, the radioactive material container can be installed in and move out from the outer shield by using a hooking tool to protect the operating personnel.

Furthermore, the present invention provides a shipping apparatus for safely and conveniently transporting the storage device.

The storage device provided by the present invention includes a radioactive material container, a radioactive material container outer shield and a ring member. The container includes a lower cup portion, an upper cup portion which is securely engaged to the lower cup portion, and a chamber with a cushion member mounted in a top and a bottom end thereof, which is formed inside the container for storing radioactive material. The outer shield includes a base portion and a lid which is securely covered on the base portion, the base portion further including a room to accommodate the radioactive material container. The ring member is pivotedly connected to a top end of the radioactive material container, and is rested between the lid and the upper cup portion. When the lid is opened, the ring member will stand out of the base portion for a tool to conveniently move out the container from the outer shield.

The shipping apparatus provided by the present invention includes a bag body having a protective foam surrounding a hollow space for holding the storage device inside the body bag, a retractable handle extended upwardly from the bag body, and a plurality of wheels mounted under the bag body.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These, as well as other features of the present invention, will become apparent upon reference to the drawings wherein.

DETAILED DESCRIPTION OF THE INVENTION

Figure 1:
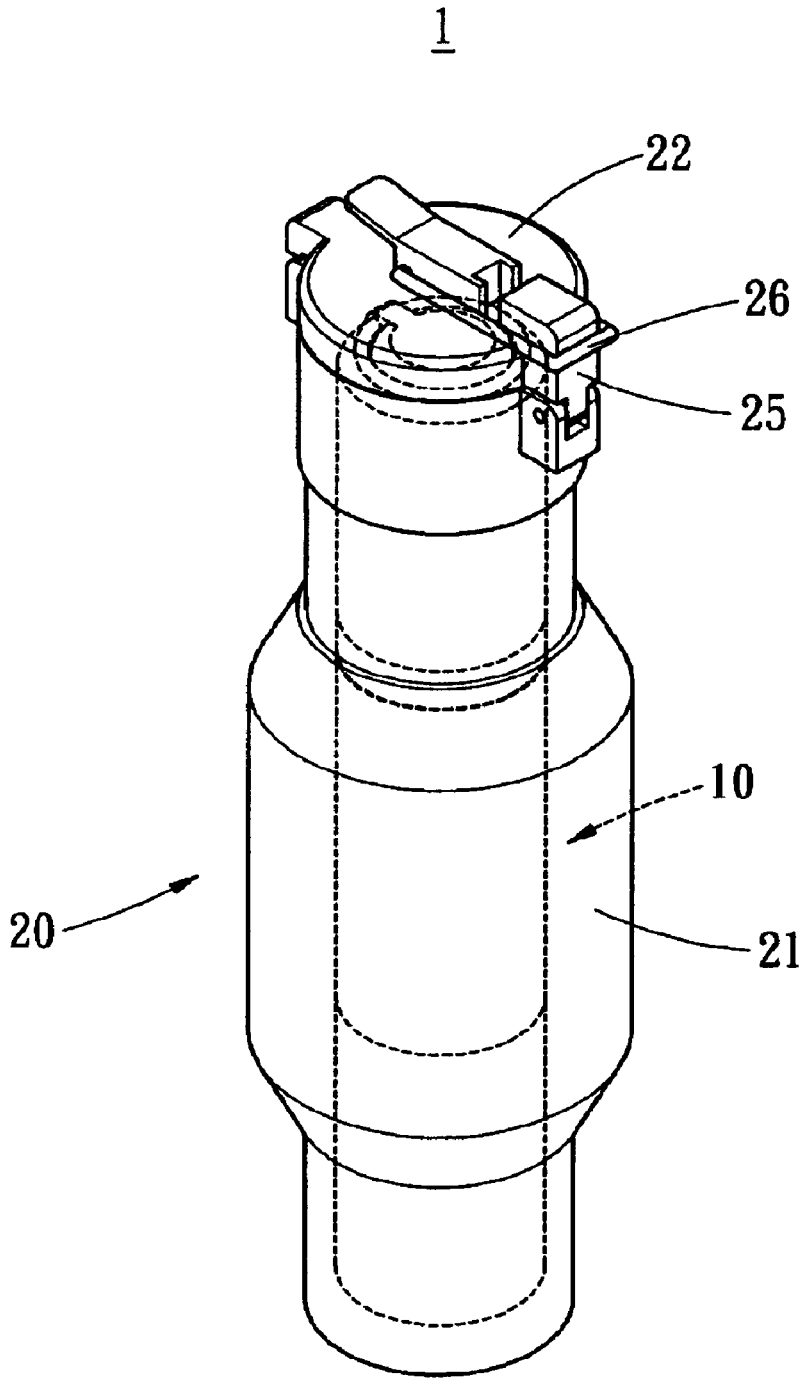
FIG. 1 shows a perspective view of a device for storing radioactive material according the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
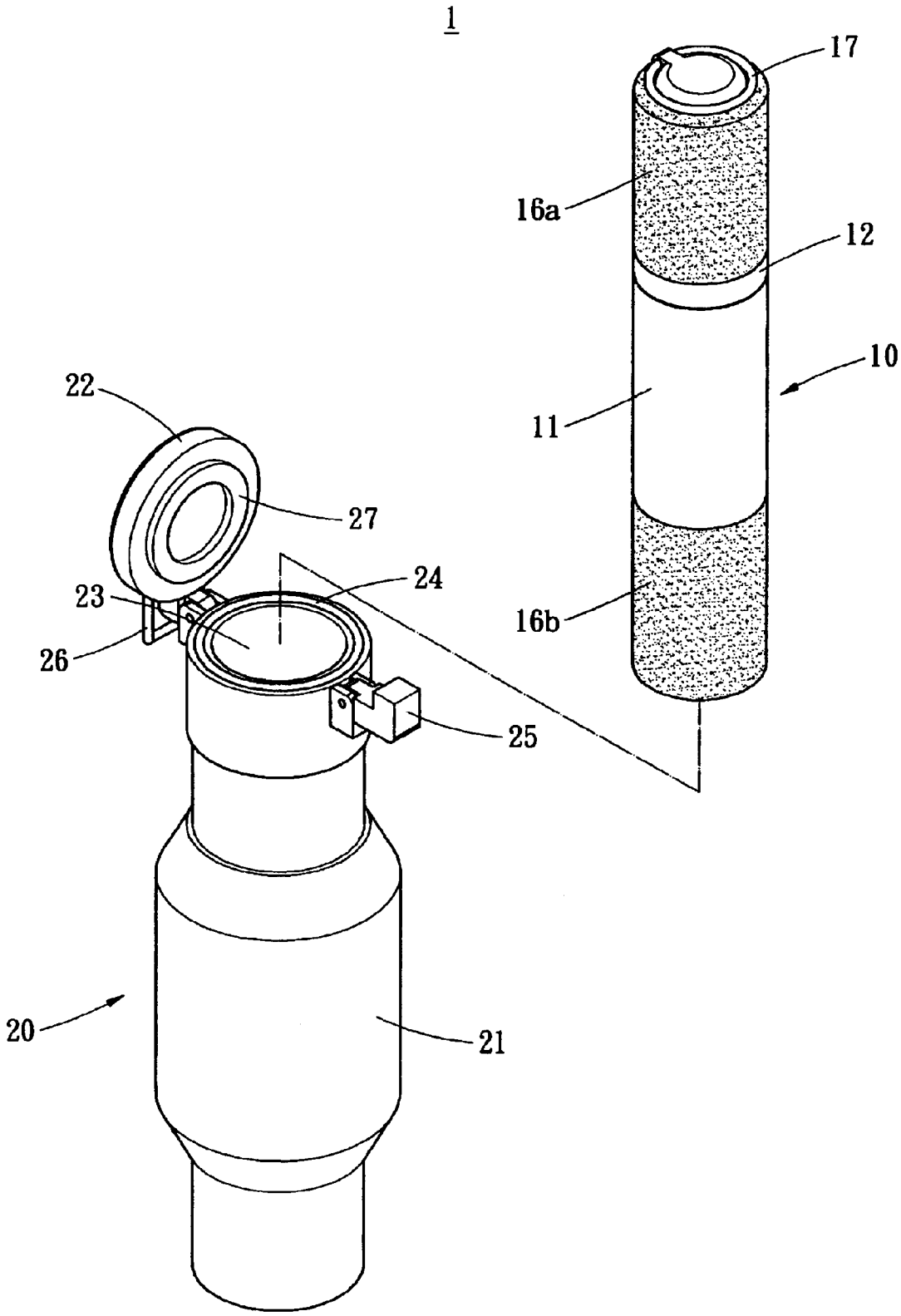
FIG. 2 shows an exploded view of the storage device including a radioactive material container and a radioactive material container outer shield.

Referring to FIGS. 1 and 2, a perspective view of a device for storing radioactive material, and an exploded view of a radioactive material container and a radioactive material container outer shield of the storage device according to the present invention are illustrated, respectively. The radioactive material container 10 can be installed in and move out from the radioactive material container outer shield 20 of the storage device 1.

Figure 3:
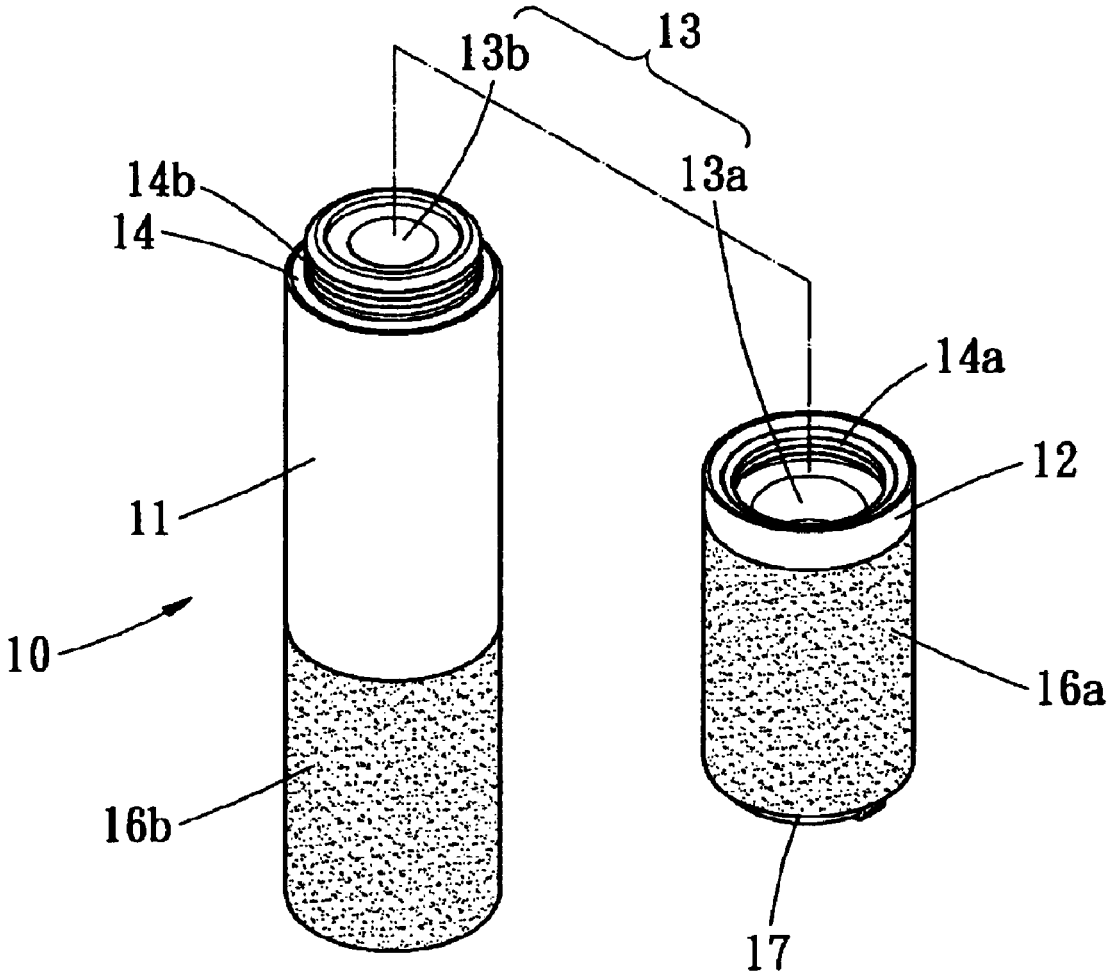
FIG. 3 shows a perspective view of an opening status of the radioactive material container.
Figure 5:
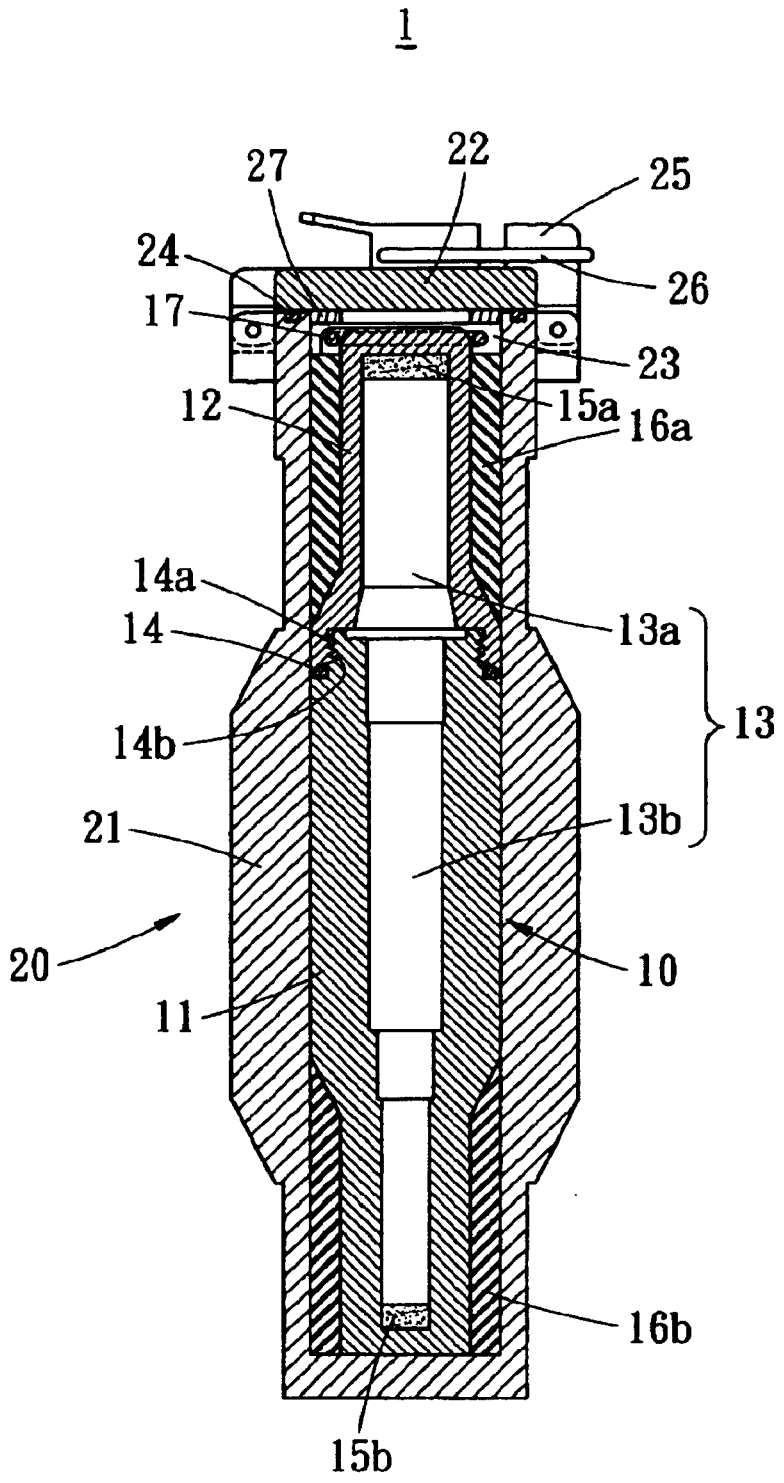
FIG. 5 shows a cross sectional view of a closed status of the storage device.

As shown in FIG. 3, the radioactive material container 10 includes a lower cup portion 11 and an upper cup portion 12 which can be securely engaged to the lower cup portion 11. Both the lower cup portion 11 and the upper cup portion 12 are preferably constructed of tungsten, but any radiation-resistant material such as lead maybe used. A chamber 13, as shown in FIG. 5, is formed inside the container 10 for storing radioactive material. In the preferred embodiment, the chamber 13 includes an upper and a lower internal cavities 13*a* and 13*b* formed in the upper cup portion 12 and the lower cup portion 11, respectively, which is formed while the radioactive material container 10 is assembled by connecting the upper cup portion 12 to the lower cup portion 11. The chamber 13 is syringe-like to receive a syringe holding the radioactive material.

Please refer to FIGS. 3 and 5 again. The lower cup portion 11 has a threaded area 14*b* on the external surface of the open end of the lower cavity 13*b*. On the other hand, the upper cup portion 12 has a threads 14*a* on the internal surface of the open end of the upper cavity 13*a* configured to engage the threads of the threaded area 14*b* of the lower cavity 13*b* on the lower cup portion 11. Moreover, an O-ring 14 fits between the lower cup portion 11 and the upper cup portion 12 to provide an air and fluid tight seal. As such, the radioactive material container 10 provides a first shielding structure for storing the radioactive material. Meanwhile, there are cushion members 15*a* and 15*b* mounted in both ends of the chamber 13, respectively, that is, the cushion member 15*a* is mounted in the closed end of the upper cavity 13*a*, and a cushion member 15*b* is mounted in the closed end of the lower cavity 13*b*. The cushion member 15*a* and 15*b* can be a sponge to reduce the shock and collision when the storage device 1 is transported.

Furthermore, as shown in FIG. 3, in order to conveniently grasp and combine the upper cup portion 12 and the lower cup potion 11, a roughened surface 16*a* and 16*b*, such as made of polymer such as ABS or other equivalent material, are formed on a surface thereof, respectively.

Figure 4:
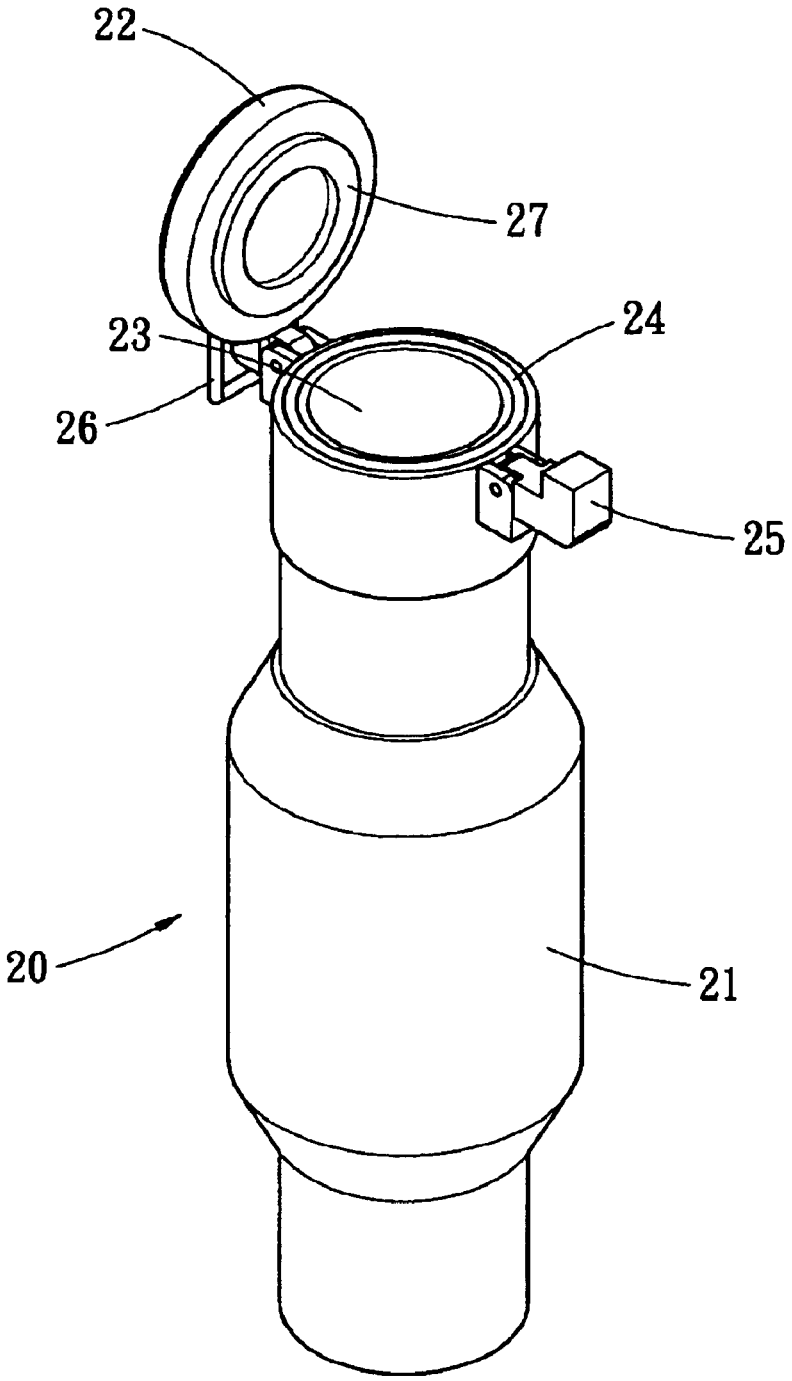
FIG. 4 shows a perspective view of an opening status of the storage device.

Referring now to FIGS. 1 and 4, the radioactive material container outer shield 20 includes a base portion 21 and a lid 22 which can be securely covered on the base portion 21. Both the base portion 1 and the lid 12 are also preferably constructed of tungsten, but any radiation-resistant material such as lead maybe used. The outer shield 20 is used as a second shielding structure for receiving the radioactive material container 10. In the preferred embodiment, the base portion 21 has a room 23 to accommodate the radioactive material container 10. It is preferably the radioactive material container 10 precisely fits to the room 23 to prevent from shaking.

As shown in FIGS. 4 and 5, a buckle member 25 is pivotedly mounted on an outer surface of the open end of the base portion 21, and the lid 22 is pivotedly mounted to the base portion 21 opposite to the buckle member 25. Moreover, the lid 22 has a resilient snap 26 to snap on the buckle member 25 after the lid 22 is covered on the base portion 21, and buckled by the buckle member 25. Similarly, an O-ring 24 is used to provide a seal between the open end of the base portion 21 and the lid 22. Such that, the room 23 in the radioactive material outer shield 20 can be sealed to provide second shielding protection with the radioactive material container 10 nested therein.

Figure 6:
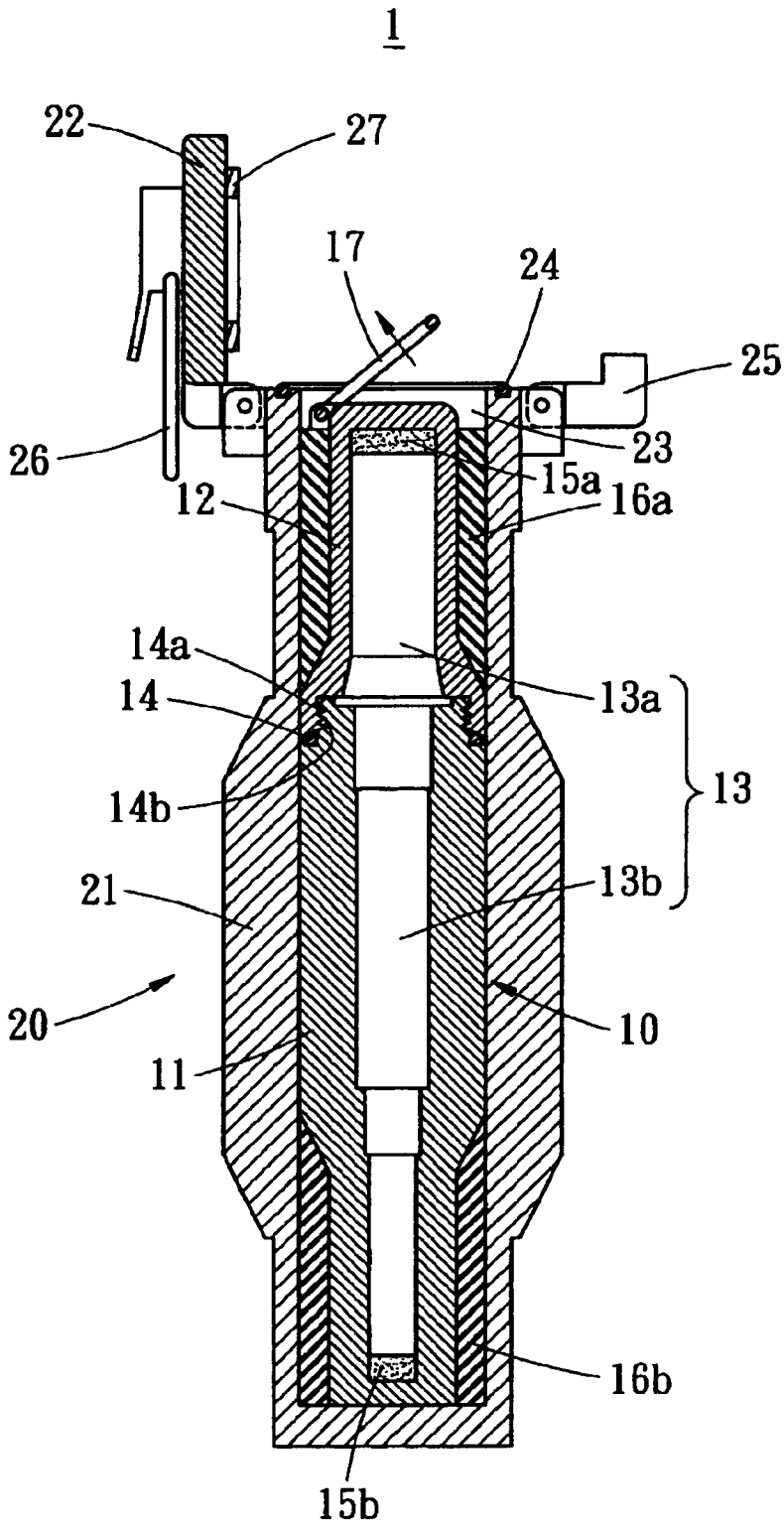
FIG. 6 shows a cross sectional view of the opening status of the storage device.

Referring now to FIGS. 2, 5 and 6, the storage device 1 of the present invention further includes a ring member 17 pivotedly connected to the top end of the radioactive material container 10. The ring member 17 can stand out of the base portion 21 when the lid 22 is opened. Therefore, a tool 30, such as a container hook, can be used to hook the ring member 17 to pull out of the container 10 from the outer shield 20. As such, it reduces the chances for the operating personnel to contact the container 10.

Please refer back to FIGS. 4 and 5 again, in this preferred embodiment, a magnetic mechanism is used to raise the ring member 17. A magnetic member 27 is mounted on the bottom surface of the lid 22 while the ring member 17 is made by the material which is attracted by the magnetic member 27. When the radioactive material container 10 is put in the outer shield 20, the ring member 17 is rested on the top surface of the upper cup portion 12. Meanwhile, when the lid 22 is covered on the base 21, the magnetic member 27 is faced closely to the ring member 17.

As shown in FIG. 6, when the lid is opened, due to the magnetism, the ring member 17 is attracted by the magnetic member 27 to stand out of the base portion 21.

Figure 7:
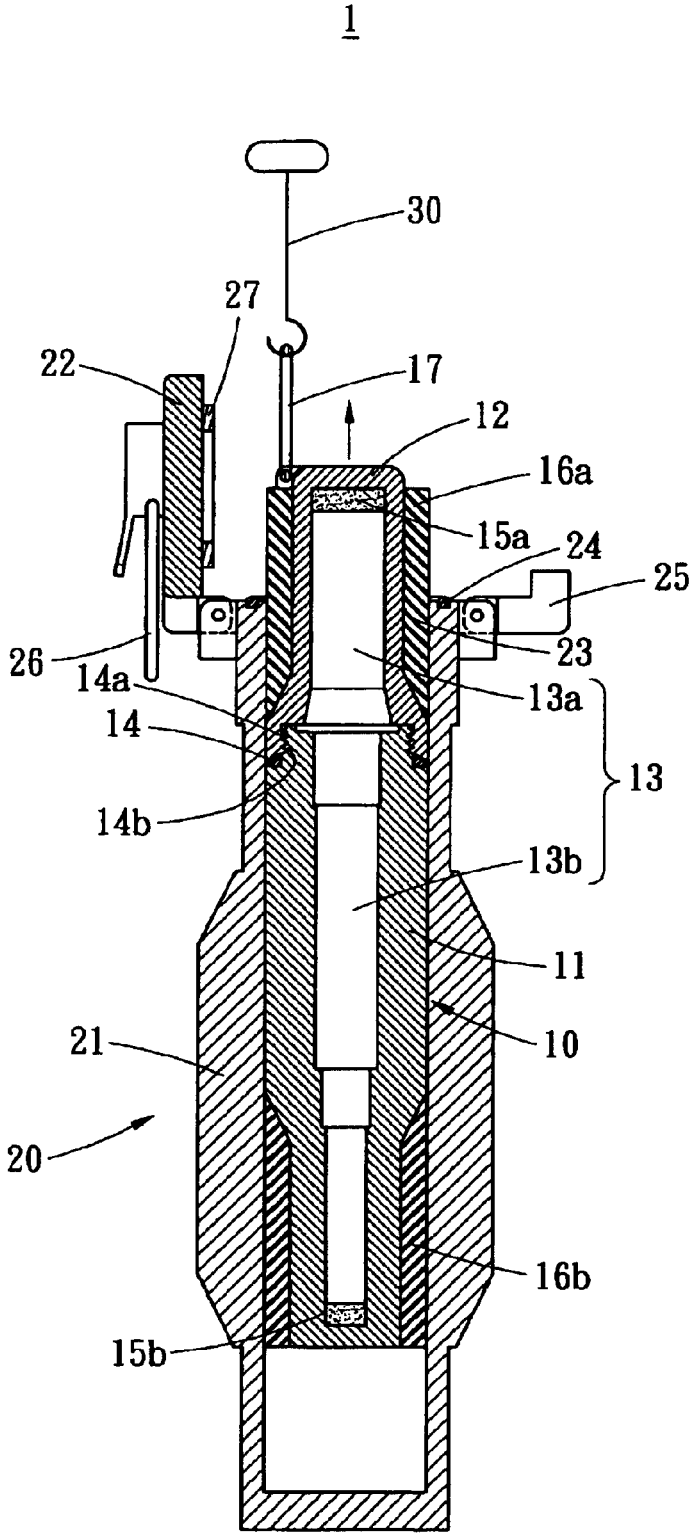
FIG. 7 shows a cross sectional view of the radioactive material container being removing out of the radioactive material container outer shied by using a tool.

Referring to FIG. 7, a tool 30 is used to hook the ring member 17 to pull out of the radioactive material container 10. As such, a proper solution is provided to prevent the operating personnel from contacting the container 10.

Furthermore, an elastic mechanism can also be used to raise the ring member 17. An elastic member (not shown) may be furnished between the upper cup portion 12 and the ring member 17. Therefore, when the lid 21 is opened, the ring member 17 is raised by the elastic member.

Thereby, the device for storing radioactive material with secure seal and firmly lock is obtained according the above-mentioned description.

Figure 8:
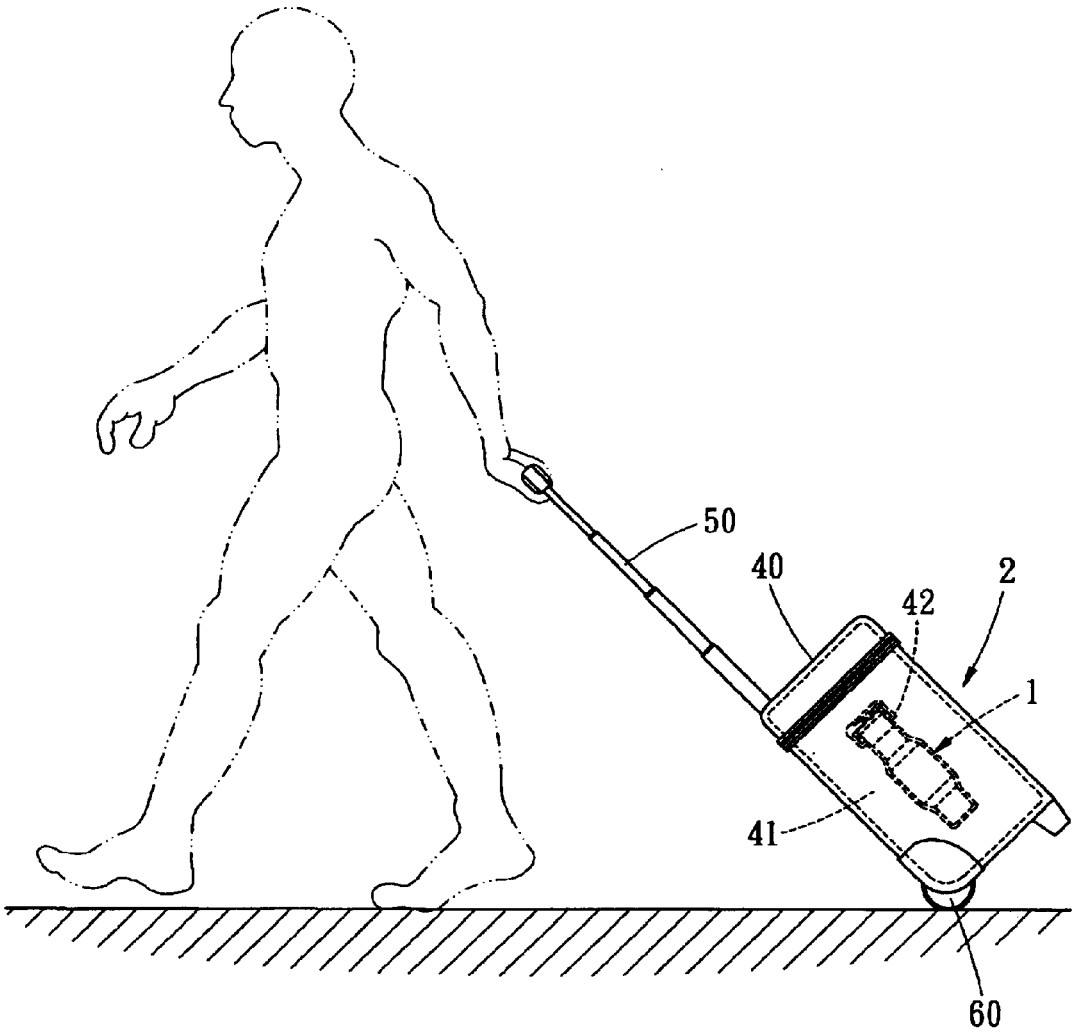
FIG. 8 shows an application of a shipping apparatus for transporting the storage device.
Figure 9:
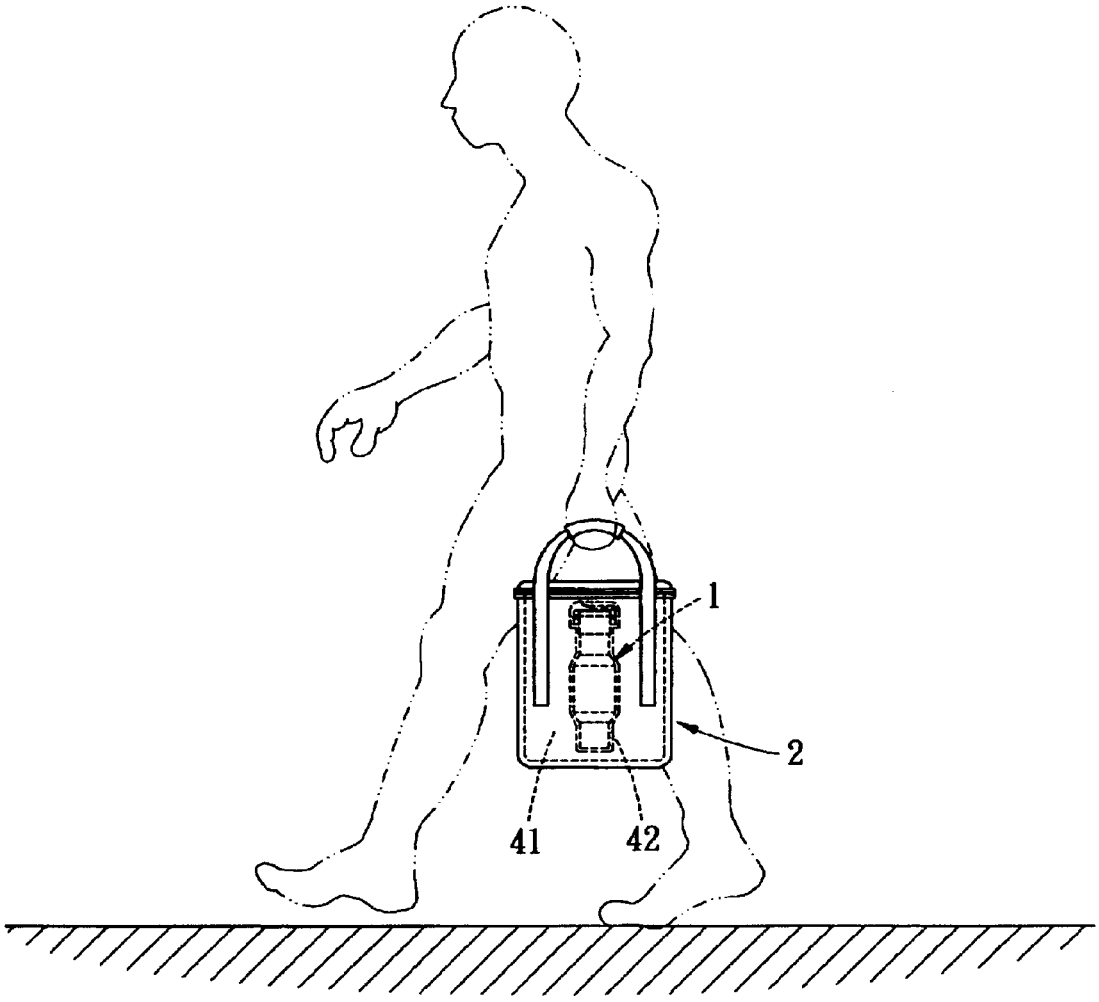
FIG. 9 shows another preferred embodiment of the shipping apparatus.

Finally, as shown in FIGS. 8 and 9, for example, different kind of shipping apparatuses 2 are provided to transport the storage device 1. As shown in FIG. 8, the shipping apparatus 2 is a radioactive material shipping bag with radiation-resistant ability. The shipping apparatus 2 includes a bag body 40, a retractable handle 50 extended upwardly from the bag body 40 for the operating personnel keeping away from the storage device 1 to safely move the bag body 40. There are a plurality of wheels 60 mounted under the bag body 40 for convenient conveyance. Moreover, the bag body 40 includes a protective foam 41 made of polymer such as EVA foam or the equivalent material, surrounding a hollow space 42 inside the bag body 40 for holding the storage device 1. Therefore, the storage device 1 of the present invention can be transported more safely. Instead, as shown in FIG. 9, the shipping apparatus 2 includes only a bag body 40' and two handles 50' fixedly furnished on the bag body 40' can also provide the same function to transport the storage device 1.

This disclosure provides exemplary embodiments of the present invention. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

I claim:

1. A device for storing radioactive material, comprising a radioactive material container including a lower cup portion, an upper cup portion which is securely engaged to the lower cup portion, and a chamber with a cushion member mounted in a top and a bottom end thereof, which is formed inside the container for storing radioactive material; and a radioactive material container outer shield including a base portion and a lid which is securely covered on the base portion, the base portion further including a room to accommodate the radioactive material container wherein the said radioactive material container comprises a ring member pivotedly connected to a top end and rested between the lid and the upper cup portion, wherein when the lid is opened, the ring member will stand out of the base portion, further comprising a buckle member pivotedly mounted on an outer surface of the open end of the base portion, the lid pivotedly mounted to the base portion opposite to the buckle member, and an O-ring provide between the base portion and the lid, wherein the lid further includes a resilient snap to snap on the buckle member after the lid is buckled by the buckle member.

2. The device of claim 1, wherein the lower cup portion, the upper cup portion, the base portion and the lid are made of radiation-resistant material.

3. The device of claim 2, wherein the radiation-resistant material includes lead.

4. The device of claim 2, wherein the radiation-resistant material includes tungsten.

5. The device of claim 1, wherein a roughened surface is formed on an outer surface of the lower or the upper cup portions.

6. The device of claim 4, wherein the roughened surface is made of polymer.

7. The device of claim 1, wherein the upper cup portion includes a threads configured to engage the threads of a threaded area of the lower cup portion, and an O-ring fits between the lower and the upper cup portions.

8. The device of claim 1, wherein the chamber is syringe-like.

9. The device of claim 8, wherein the chamber is formed by combining an upper and a lower internal cavities of the upper and the lower cup portions, respectively.

10. The device of claim 1, wherein the cushion member is a sponge.

11. The device of claim 1, further comprising a magnetic member mounted on a bottom surface of the lid while the ring member is made by material capable of being attracted by the magnetic member, such that when the lid is opened, the ring member is attracted by the magnetic member to stand out of the base portion.

12. The device of claim 1, further comprising an elastic member furnished between the upper cup portion and the ring member such that when the lid is opened, the ring member is raised by the elastic member.

13. The device of claim 1, further comprising a tool for moving out the radioactive material container from the outer shield.

14. The device of claim 13, wherein the tool is a container hook.

15. The device of claim 1, further comprising a shipping apparatus for transportation of a radioactive material storing device, the shipping apparatus comprising:

a body bag including a protective foam surrounding a hollow space for holding the storing device inside the body bag;

a retractable handle extended upwardly from the bag body; and a plurality of wheels mounted under the bag body.

16. The device of claim 15, wherein the protective foam is made of polymer.

17. The device of claim 1, further comprising a shipping apparatus for transportation of a radioactive material storing device, the shipping apparatus comprising:

a body bag including a protective foam surrounding a hollow space for holding the storing device inside the body bag; and two handles fixedly furnished on the bag body.

18. The device of claim 17, wherein the protective foam is made of polymer.

* * * * *